US005797067A

United States Patent [19]

Mitekura

[11] Patent Number: 5,797,067

[45] Date of Patent: Aug. 18, 1998

[54] IMAGE FORMING APPARATUS WHICH DISPLAYS AN ACCUMULATED NUMBER OF TIMES IMAGE FORMATION HAS BEEN EXECUTED FOR EACH OF IMAGE FORMING MODES

[75] Inventor: Yoshihiro Mitekura, Yokohama, Japan

[73] Assignee: Ricoh Company, Ltd., Tokyo, Japan

[21] Appl. No.: 738,688

[22] Filed: Oct. 28, 1996

[30] Foreign Application Priority Data

Oct. 28, 1995 [JP] Japan ..... 7-303422

[51] Int. Cl.[6] ..... G03G 21/00

[52] U.S. Cl. ..... 399/79; 399/81; 377/13

[58] Field of Search ..... 399/10, 24, 79, 399/81, 361; 377/8, 13, 15

[56] References Cited

FOREIGN PATENT DOCUMENTS

| | | |
|---|---|---|
| 62-222267 | 9/1987 | Japan . |
| 1-122655 | 8/1989 | Japan . |
| 4-256967 | 2/1992 | Japan . |
| 7-199744 | 8/1995 | Japan . |

*Primary Examiner*—Joan H. Pendegrass

*Attorney, Agent, or Firm*—Oblon, Spivak, McClelland, Maier & Neustadt, P.C.

[57] ABSTRACT

An image forming apparatus which forms an image on a sheet in accordance with an image forming mode selected from among a plurality of image forming modes is provided with a counter to accumulate the number of times image formation has been executed for each of the plurality of image forming modes. The counter includes a memory to store the accumulated number of times image formation has been executed for each of the plurality of image forming modes and a display to display content of the memory.

30 Claims, 11 Drawing Sheets

IMAGE FORMING APPARATUS WHICH DISPLAYS AN ACCUMULATED NUMBER OF TIMES IMAGE FORMATION HAS BEEN EXECUTED FOR EACH OF IMAGE FORMING MODES

BACKGROUND OF THE INVENTION

1. Field of the Invention

The present invention relates to an image forming apparatus which forms an image on a sheet in accordance with an image forming mode selected from among a plurality of image forming modes, and more particularly to an image forming apparatus which accumulates a number of times image formation has been executed for each of the plurality of image forming modes and displays the accumulated number of times image formation has been executed for each mode.

2. Discussion of the Background

As an image forming apparatus which forms an image on a sheet in accordance with an image forming mode selected from among a plurality of image forming modes, there is known, for example, an electrophotographic copying machine, a printer, a facsimile machine and a multi-function machine having copying, printing and facsimile functions, and so on.

The image forming apparatus as mentioned above generally includes a wide variety of image forming modes. As examples, a full color image forming apparatus typically includes a full color mode for forming an image on a sheet in full color, a black mode for forming an image on a sheet in black, a cyan mode for forming an image on a sheet in cyan, a magenta mode for forming an image on a sheet in magenta, a yellow mode for forming an image on a sheet in yellow, a red mode for forming an image on a sheet in red, a blue mode for forming an image on a sheet in blue and a green mode for forming an image on a sheet in green. Further, the full color image forming apparatus may include a mono color copy mode for forming a copy in mono color, a full color copy mode for forming a copy in full color, a mono color facsimile mode for recording a received facsimile image in mono color, a full color facsimile mode for recording a received facsimile image in full color, a mono color print mode for printing an output of a computer, which is connected to the apparatus, on a sheet in mono color and a full color print mode for printing such an output on a sheet in full color. Generally, an operator selects one of these modes by manipulating an operational key of an operational panel of the apparatus.

On the other hand, there is a need for counting a number of times image formation has been executed for each of the plurality of image forming modes individually, because a maintenance fee for the apparatus under a maintenance contract is generally determined based upon the number of times the apparatus has formed an image on a sheet, and further, a different unit fee is set for each of the plurality of image forming modes. Generally, a total maintenance fee for a month for the apparatus is determined by multiplying the number of times image formation has been executed for each mode during the month with the corresponding unit fee for one time of the image formation and aggregating the result for each mode.

Therefore, an image forming apparatus having a plurality of image forming modes is generally provided with a mechanical counter for each of the plurality of image forming modes for counting and accumulating the number times image formation has been executed for each respective image forming mode.

However, if such a mechanical counter is provided for each of the plurality of image forming modes for counting and accumulating the number of times image formation has been executed for each respective image forming mode, there occurs a problem that the number of the counters needs to increase as the number of the image forming modes increases. For example, in a case of a full color image forming apparatus having 8 image forming modes as described earlier, 8 counters are necessary for counting individually the number of times image formation has been executed for each of the 8 image forming modes. If the 8 counters are desired to be included inside of the apparatus, a space for the 8 counters is required inside of the apparatus and the size of the apparatus becomes relatively large due to such a space requirement. Further, it is rather difficult to identify a counter corresponding to a desired image forming mode among 8 counters placed side by side, and it is furthermore difficult to see a number indicated by each of the 8 counters placed side by side.

SUMMARY Of THE INVENTION

The present invention has been made in view of such problems and addresses and solves these problems.

Accordingly, an object of the present invention is to provide a novel image forming apparatus capable of counting and accumulating the number of times image formation has been executed for each of a plurality of image forming modes and displaying the accumulated number of times image formation has been executed for each mode with a relatively small number of counters, even if the number of the image forming modes is relatively large.

In order to achieve the above-mentioned object, the novel image forming apparatus of the present invention which forms an image on a sheet in accordance with an image forming mode selected from among a plurality of image forming modes is provided with, according to the present invention, an operational panel which includes a device for selecting an image forming mode to form an image on a sheet. A first controller counts the number of times image formation has been executed for each of the plurality of image forming modes, and a counter accumulates the number of times image formation has been executed individually for each of the plurality of image forming modes in accordance with a count signal for the corresponding image forming mode from the first controller. The counter includes a first memory for storing therein the accumulated number of times image formation has been executed for each of the plurality of image forming modes. The counter further includes a display to display contents of the first memory. The counter displays the accumulated number of times image formation has been executed for the selected image forming mode, which is stored in the first memory, in accordance with a display signal for the corresponding image forming mode from the first controller.

The image forming apparatus of the present invention further includes a device for switching the image forming mode a user desires to input to the counter, from among the plurality of image forming modes, for displaying on the display of the counter the accumulated number of times image formation has been executed for such a mode, which is stored in the first memory of the counter. The first controller transmits information of the image forming mode selected and input by the user through the mode switching device to the counter for displaying the number of times image formation has been executed for such an input mode, which is stored in the first memory of the counter.

Furthermore, the image forming apparatus of the present invention includes a second controller which counts and accumulates the number of times image formation has been executed for each of the plurality of image forming modes. The second controller includes a second memory to store the accumulated number of times image formation has been executed for each of the plurality of image forming modes. The apparatus further includes a further display provided on the operational panel for displaying contents of the second memory and the second controller controls to display on the further display on the operational panel the accumulated number of times image formation has been executed for the mode selected and input by the mode switching device, which is stored in the second memory of the second controller.

Still further, the image forming apparatus of the present invention includes a device for calculating a difference between the accumulated number of times image formation has been executed for each of the plurality of image forming modes stored in the first memory of the counter and the corresponding accumulated number of times image formation has been executed stored in the second memory of the second controller and for determining if the calculated difference exceeds a predetermined value, and a device for displaying, when the difference exceeds the predetermined value, a message indicating that the difference exceeds the predetermined value on the display on the operational panel.

The calculating device calculates the difference and determines if the difference exceeds the predetermined value each time the image forming apparatus is turned on and/or each time the image forming apparatus adjusts image forming elements of the apparatus for correcting deterioration of the image forming elements.

BRIEF DESCRIPTION Of THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION Of THE PREFERRED EMBODIMENTS

Figure 1:
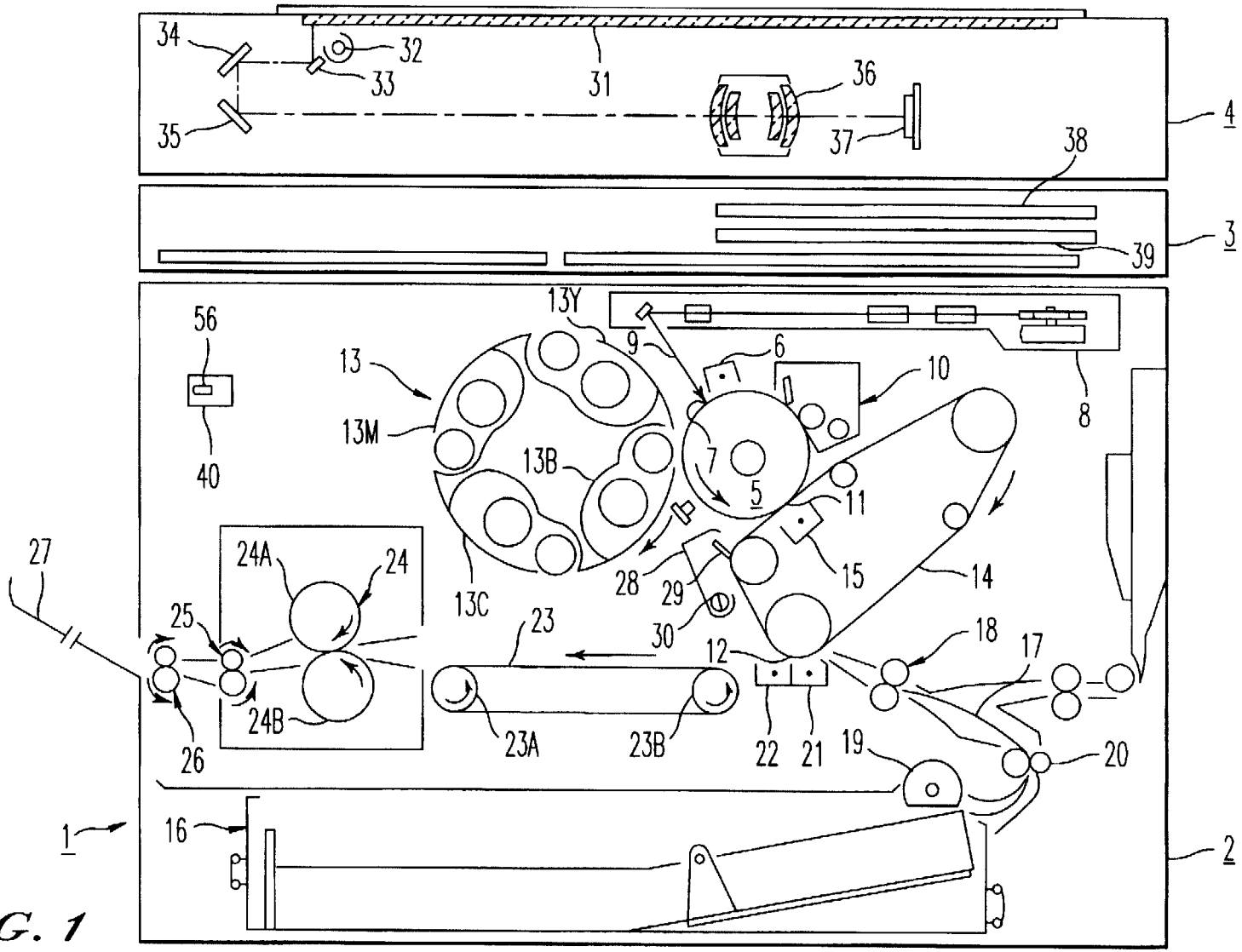
FIG. 1 is a sectional view showing an example of an image forming apparatus.

Referring now to the drawings, wherein like reference numerals designate identical or corresponding parts throughout the several views, embodiments of the present invention are explained hereinbelow.

FIG. 1 is a sectional view illustrating a full color image forming apparatus 1 according to the present invention which is capable of forming an image on a sheet both in full color and in mono color. As shown in FIG. 1, the apparatus includes an original document reading part 4, a control part 3 and a printer part 2.

First, a construction of the printer part 2 is explained by way of explaining an operation of a full color mode for forming an image on a sheet in full color. A drum-shaped photoconductor 5, which is a principal element of the printer part 2, is an example of an image carrying member, and is rotated in a counterclockwise direction in FIG. 1 by a driving motor (not shown). When the photoconductor 5 is rotated, a surface of the photoconductor 5 is charged uniformly by an operation of a charger 6, which is an example of a charging device. Then, a laser light 9 from a laser light writing system 8 exposes an exposure part 7 on the surface of the photoconductor 5 to form a latent image on the surface of the photoconductor 5.

The latent image formed on the surface of the photoconductor 5 is developed to a visible image first as a toner image in black with a black developing unit 13B of a revolving development apparatus 13 which includes the black developing unit 13B, a yellow developing unit 13Y, a magenta developing unit 13M and a cyan developing unit 13C. An intermediate transfer belt 14, which is an example of an intermediate image transfer member, passes around a plurality of rollers so as to rotate in a clockwise direction, and the black toner image on the surface of the photoconductor 5 is transferred onto a surface of the intermediate transfer belt 14 by an operation of a transfer charger 15.

After transfer of the black toner image from the photoconductor 5 to the intermediate transfer belt 14, latent images of the other colors yellow, magenta and cyan are sequentially formed on the surface of the photoconductor 5, and each of the latent images is developed to a yellow toner image, a magenta toner image, a cyan toner image, respectively, by the corresponding developing units 13Y, 13M and 13C of the revolving development apparatus 13. Each of the toner images is sequentially transferred upon the black toner image on the intermediate transfer belt 14, which was transferred first, to form a full color toner image on the intermediate transfer belt 14. Residual toner on the surface of the photoconductor 5 is removed by a cleaning unit 10 each time the toner image on the surface of the photoconductor 5 is transferred to the intermediate transfer belt 14.

While the full color toner image is formed on the surface of the photoconductor 5 as described above, a transfer sheet 17 is fed out from a sheet tray of a sheet feeding unit 16 by rotation of a feeding roller 19 and is conveyed towards a pair of registration rollers 18 via a conveying roller 20. Once a leading edge of the transfer sheet 17 reaches the pair of the registration rollers 18, the transfer sheet 17 is conveyed towards a transfer part 12 by rotation of the pair of the registration rollers 18 so that a leading edge of the full color toner image on the intermediate transfer belt 14 registers with the leading edge of the transfer sheet 17 at the transfer part 12. The full color toner image on the surface of the intermediate transfer belt 14 is then transferred to the transfer sheet 17 by an operation of a transfer charger 21. The transfer sheet 17 is then separated from the intermediate transfer belt 14 by an operation of a separating charger 22.

The transfer sheet 17 which is separated from the intermediate transfer belt 14 is then conveyed towards a pair of fixing rollers 24 by rotation of a conveying belt 23 which is passed around a pair of rollers 23A and 23B, and which conveying belt 23 is rotated in a counterclockwise direction in FIG. 1.

The pair of fixing rollers 24 includes a heat fixing roller 24A and a pressure roller 24B which is in contact with the heat fixing roller 24A. The rollers 24A and 24B are driven respectively in directions indicated by arrows in FIG. 1 and the toner image on the transfer sheet 17 is fixed on the transfer sheet 17 when the transfer sheet 17 passes between the rollers 24A and 24B. The transfer sheet 17 is then conveyed towards an exit tray 27 by rotation of a pair of conveying rollers 25 and a pair of exit conveying rollers 26 to be exited on a tray 17 as a sheet carrying a full color image.

The intermediate transfer belt 14 is provided with a cleaning unit 28 for cleaning a surface of the intermediate transfer belt 14 at a position facing the intermediate transfer belt 14, and residual toner remaining on the surface of the intermediate transfer belt 14 after the toner image is transferred to the transfer sheet 17 is cleaned by a cleaning member 29 of the cleaning unit 28. Toner which is thus recovered by the cleaning member 29 is conveyed out of a case of the cleaning unit 28 by a toner conveying member 30 of the cleaning unit 28. The cleaning member 29 is constructed so as to be separated from the intermediate transfer belt 14 except when cleaning the intermediate transfer belt 14 so that the toner image on the intermediate transfer belt 14 is not disturbed by the cleaning member 29.

As described above, in the full color mode, a toner image in each of black, yellow, magenta and cyan is sequentially formed on the surface of the photoconductor 5, and each toner image is transferred to the surface of the intermediate transfer belt 14 sequentially superimposing one image after another. In other words, in the full color mode, an image forming operation is performed four times in total for making a full color image on the intermediate transfer belt 14, and the full color image thus formed is then transferred to the transfer sheet 17. In short, four image forming operations are performed for forming one full color image on a sheet.

In a case of a black mode for forming an image on a sheet in black, the latent image formed on the photoconductor 5 is developed to a visible image as a black toner image by the black developing unit 13B. The black toner image is transferred to the intermediate transfer belt 14 and is then transferred to the transfer sheet 17, and the transfer sheet 17 carrying the black toner image is then exited to the exit tray 27. Thus, in the case of the black mode, only one image in black is formed on the photoconductor 5. In other words, the image forming operation is performed only one time for forming one black image on a sheet. Except that the image forming operation is performed only one time, other aspects of the image forming operation in the black mode are the same as the aspects in the full color mode.

Similarly, in cases of the cyan mode for forming a cyan image on a sheet, the magenta mode for forming a magenta image on a sheet and the yellow mode for forming a yellow image on a sheet, one latent image of the corresponding color is formed on the photoconductor 5 and is developed to the visible image as the toner image in each corresponding color by the cyan developing unit 13C, the magenta developing unit 13M and the yellow developing unit 13Y, respectively. These toner images are transferred to the intermediate transfer belt 14 and then to the transfer sheets 17. Thus, in cases of these modes also, one image forming operation is performed for forming an image on a sheet.

In a case of the red mode for forming a red image on a sheet, a magenta toner image and a yellow toner image are formed sequentially on the photoconductor 5 by the magenta developing unit 13M and the yellow developing unit 13Y, respectively, and these toner images are superimposed on each other on the intermediate transfer belt 14 to form a red toner image. The red toner image thus formed on the intermediate transfer belt 14 is transferred to the transfer sheet 17. Thus, in the case of the red mode, two image forming operations are performed for forming an image on a sheet in red, in contrast to the black, cyan, magenta and yellow modes.

Similarly, in a case of the blue mode for forming a blue image on a sheet, a cyan toner image and a magenta toner image are formed sequentially on the photoconductor 5 by the cyan developing unit 13C and the magenta developing unit 13M, respectively, and these toner images are superimposed on each other on the intermediate transfer belt 14 to form a blue toner image. The blue toner image thus formed on the intermediate transfer belt 14 is then transferred to the transfer sheet 17. In a case of the green mode for forming a green image on a sheet, a yellow toner image and a cyan toner image are formed sequentially on the photoconductor 5 by the yellow developing unit 13Y and the cyan developing unit 13C, respectively, and these two toner images are superimposed on each other on the intermediate transfer belt 14 to form a green toner image. The green toner image thus formed on the intermediate transfer belt 14 is transferred to the transfer sheet 17. Thus, in the cases of the blue mode and the green mode, two image forming operations are performed respectively for forming an image on a sheet in these respective colors.

Next, the image reading part 4 is explained briefly. A contact glass 31 is provided on a case of the image reading unit 4 for placing thereupon an original document (not shown). An optical system including an original document illuminating lamp 32 and a first mirror 33 and another optical system including second and third mirrors 34 and 35 are driven to a right direction in FIG. 1 keeping a relative speed ratio of 2:1, and the original document placed on the contact glass 31 is scanned to be imaged by these optical systems. An optical image thus formed with these optical systems is imaged on a reading element 37, which is a charge-coupled device in this embodiment, through an imaging lens 36, and image information of the original document is read by the reading element 37. The image information of the original document thus read is reproduced on the transfer sheet 17 as a recorded image by the printer part 2 as described earlier.

As described above, the full color image forming apparatus 1 shown in FIG. 1 forms an image on a sheet in accordance with each image forming mode which is selected from among eight different modes of: the full color mode, the black mode, the cyan mode, the magenta mode, the yellow mode, the red mode, the blue mode and the green mode.

Generally, a user of the full color image forming apparatus 1 contracts with a servicing firm for maintaining the apparatus in a good condition, and the user normally pays a maintenance fee which is determined based on the number of times image formation has been executed in a certain period, such as for example, a month. Since the number of times image forming operations for forming an image has been executed is different for each of the plurality of image forming modes as described earlier, the servicing firm generally sets a different unit fee for each time image formation has been executed for each image forming mode. Therefore, the servicing firm needs to know the number times image formation has been executed for each of the plurality of image forming modes for charging an appropriate maintenance fee to the user.

The image forming apparatus is therefore generally provided with one mechanical counter for each image forming mode inside of the apparatus for accumulating the number of times image formation has been executed for that mode. Namely, the apparatus is provided with the same number of counters as the number of the image forming modes inside of the apparatus, and as a result, there is a problem that a size of the apparatus becomes relatively large due to the space required for the counters when the apparatus has a large number of image forming modes.

Accordingly, in order to solve the above-mentioned problem, the image forming apparatus of the present invention is provided with, inside of the apparatus, an electronic counter which accumulates the number of times image formation has been executed individually for each of the plurality of image forming modes. Further, the image forming apparatus of the present invention is so constructed that the accumulated number of times image formation has been executed for each mode is displayed on a display provided on the operational panel of the apparatus, so that the user can easily see and confirm the accumulated number of times image formation has been executed for each mode without opening a cover of the apparatus.

Hereinbelow, details of the above-mentioned electronic counter and the construction of the apparatus for displaying the accumulated number of times image formation has been executed on the display of the operational panel are explained.

Figure 2:
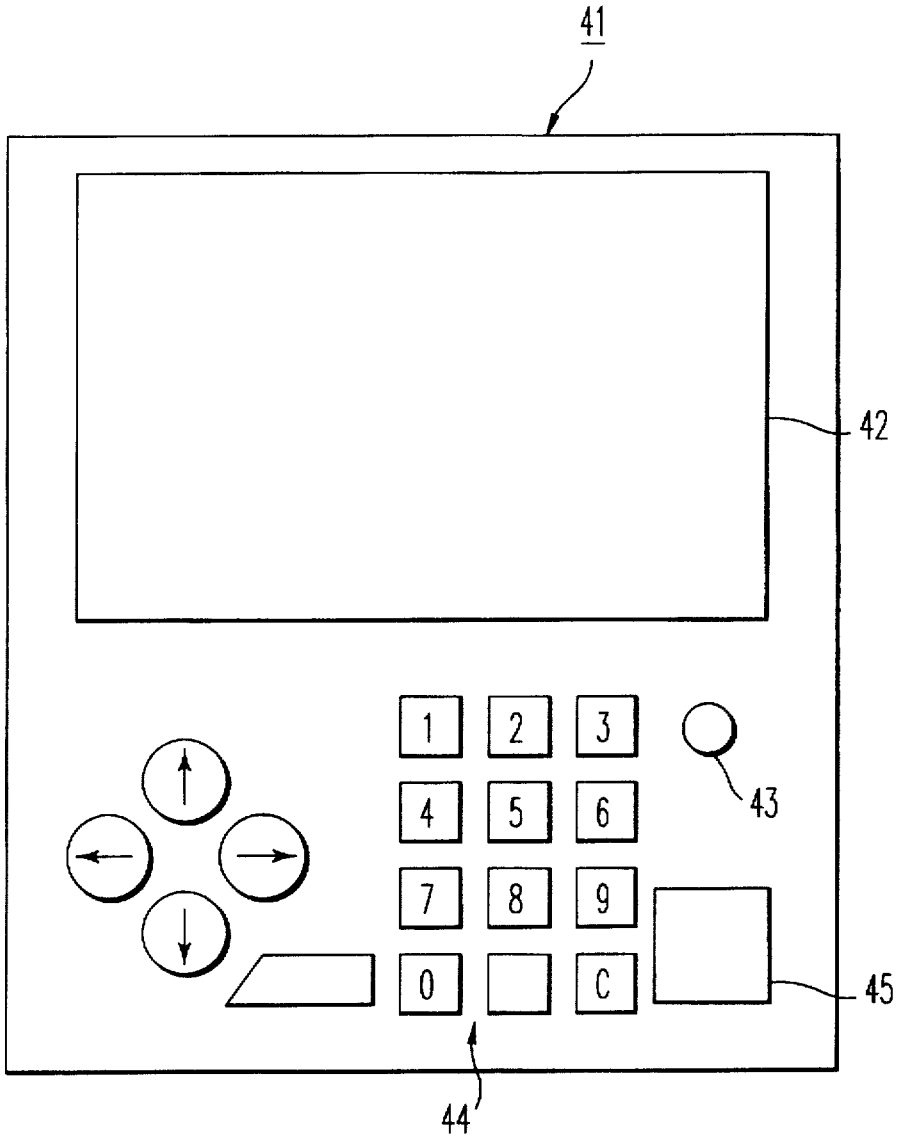
FIG. 2 is a front view of an operational panel of the image forming apparatus.
Figure 3:
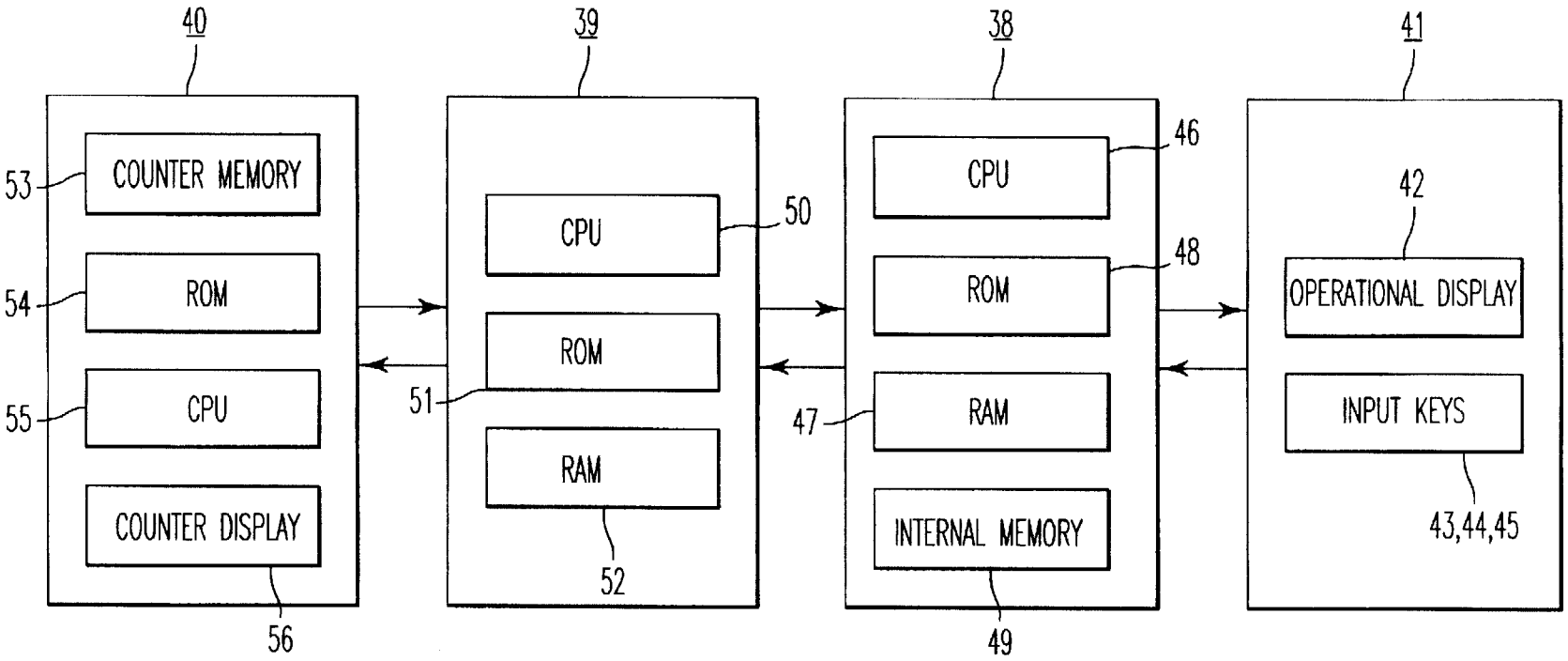
FIG. 3 is a block diagram showing a relation among elements of the image forming apparatus for counting and accumulating the number of times image formation has been executed for each of a plurality of image forming modes.

In FIG. 1, the control part 3 includes a system controller 38 and a printer controller 39 inside of the control part 3, and one unit of an electronic counter 40 is provided inside of the printer part 2. The electronic counter 40 is visible when a front cover (not shown) of a main body of the printer part 2 is opened. Further, an operational panel 41 as shown in FIG. 2 is provided on an appropriate part of a main body of the image forming apparatus 1, for example, on an upper plane of a front part of the original reading part 4. FIG. 3 is a block diagram showing a relation among the above-mentioned system controller 38, the printer controller 39, the electronic counter 40 and the operational panel 41, including a block diagram of each element, for counting and accumulating a number of times image formation has been executed for each of the plurality of image forming modes.

The operational panel 41 includes, as shown in FIG. 2, an operational display 42, which is a liquid crystal display, a counter key 43, a ten key pad 44, a start key 45 and other keys. These keys are indicated collectively as input keys in FIG. 3.

As shown in FIG. 3, the system controller 38 includes a CPU (Central Processing Unit) 46, a RAM (Random Access Memory) 47, a ROM (Read Only Memory) 48 and an internal memory 49. The CPU 46 and the RAM 47 are hereinafter referred to as a S-CPU 46 and a S-RAM 47 respectively for specifying that these are provided in the system controller 38. The internal memory 49 is a non-volatile RAM in this embodiment.

The printer controller 39 likewise includes a CPU (hereinafter referred to as a P-CPU) 50, a ROM 51 and a RAM (hereinafter referred to as a P-RAM) 52.

The electronic counter 40 includes a counter memory 53, a ROM 54, a CPU (hereinafter referred to as a C-CPU) 55 and a counter display 56. The counter memory 53 is a non-volatile memory also in this embodiment and the counter display 56 is a liquid crystal display.

Figure 4:
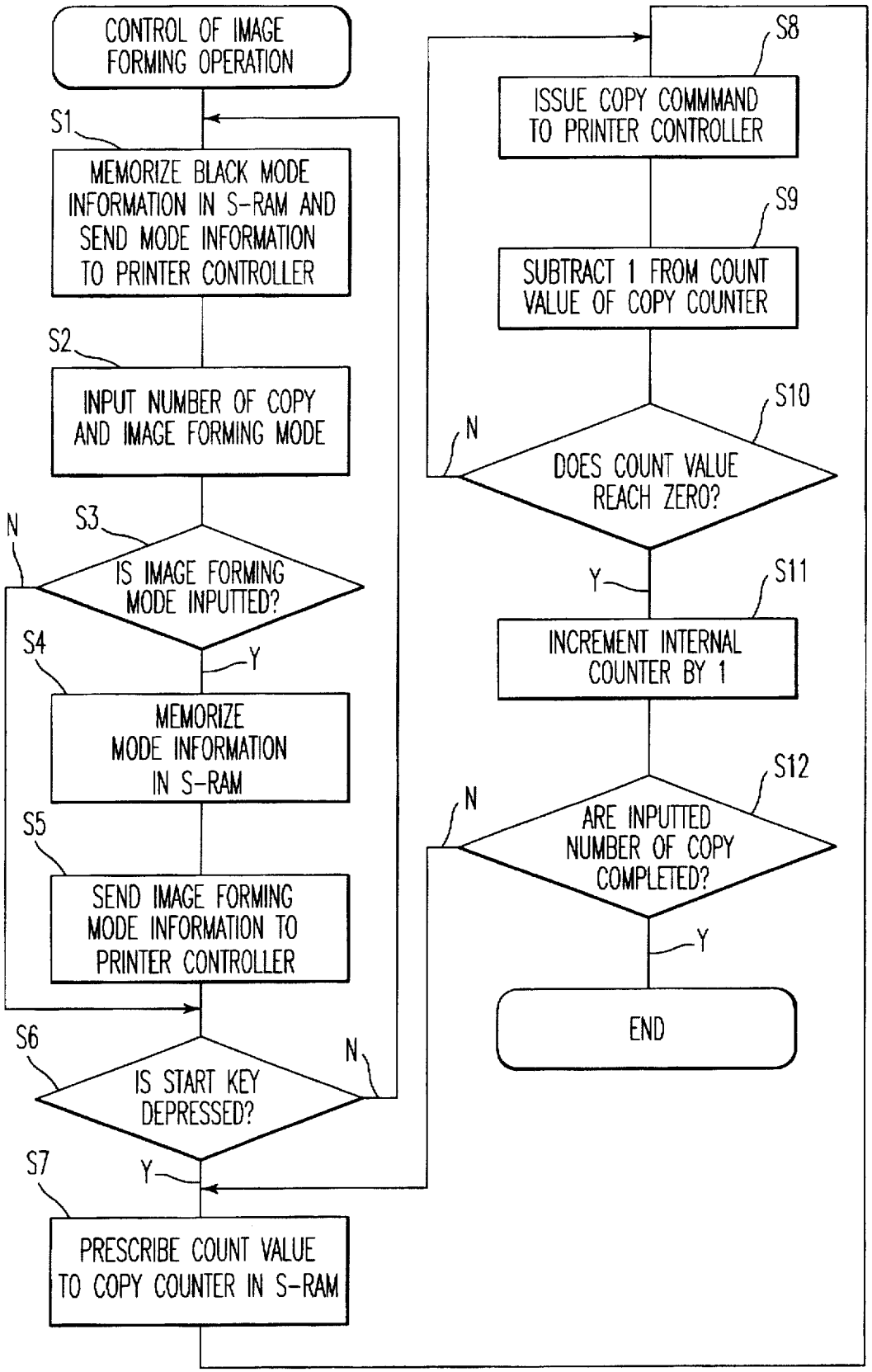
FIG. 4 is an operational flowchart of a system controller of the image forming apparatus for controlling an image forming operation and accumulating the number of times image formation has been executed for each image forming mode.

FIG. 4 is a flowchart showing an operation of the system controller 38 for controlling an image forming operation, including an operation of the S-CPU 46 of the system controller 38 for incrementing by 1 a value of a counter, which is prescribed in the internal memory 49 for each of the plurality of image forming modes.

In step S2, an operator inputs a number of copies to be made by manipulating the ten key pad 44 of the operational panel 41 shown in FIG. 2. Further, the operator selects one of the image forming modes from among the eight image forming modes described earlier, excluding the black mode which is a default mode, by depressing a mode select key displayed on the liquid crystal display of the operational display 42 of the operational panel 41.

The system controller 38 checks if the image forming mode is input in step S3. If the answer in step S3 is YES, the system controller 38 stores information of the input image forming mode in the S-RAM 47 in step S4, and further, transmits the mode information to the printer controller 39 in step S5.

Here, when the mode select key of the operational display 42 is not depressed by the operator, the black mode is selected automatically because the black mode is set as the default mode and information of the black mode is stored in the S-RAM 47 of the system controller 38, and further the black mode information is transmitted to the printer controller 39, as shown in step Si of FIG. 4.

An operation of the printer controller 39 after the selected mode information is received by the printer controller 39 is explained later.

As described above, the operational panel 41 provided on an outside of the main body of the image forming apparatus 1 includes the mode select key which is an example of a device for inputting the image forming mode desired by the operator for forming an image on a sheet.

Next, if the start key 45 of the operational panel 41 shown in FIG. 2 is depressed by the operator in step S6, the system controller 38 prescribes in step S7 a count value corresponding to the input image forming mode to a copy counter prescribed in the S-RAM 47 in accordance with the mode information stored in the S-RAM 47 of the system controller 38. Namely, a count value corresponding to the input image forming mode is prescribed and stored in the S-RAM 47. The count value for each mode corresponds to the number of times image forming operations to be performed for forming an image on a sheet is executed in each mode. For example, the count value is 4 when the full color mode is input, and the count value is 1 when the black mode is input. When other modes are input, values shown in the following Table 1 are prescribed for the respective modes.

TABLE 1

| image forming mode | prescribing count value |
|---|---|
| full color mode | 4 |
| black mode | 1 |
| cyan mode | 1 |
| magenta mode | 1 |
| yellow mode | 1 |
| red mode | 2 |
| green mode | 2 |
| blue | 2 |

Next, the S-CPU 46 of the system controller 38 issues a copy command to the printer controller 39 in step S8 of FIG. 4, and based upon this command, the image forming operation described earlier is performed. When the copy command is issued, the S-CPU 46 subtracts 1 from the count value prescribed to the copy counter in the S-RAM 47 in step S9. For example, when the full color mode is input, the prescribed count value is 4 as shown in Table 1, and the prescribed count value is subtracted by 1 and becomes 3 when the copy command is issued.

The copy command is issued the same number of times as the prescribed count value for each mode and a subtracting operation is performed each time the copy command is issued to the printer controller 39. When the count value reaches 0 in step S10, the image forming operations for forming an image on a sheet with the selected mode is completed.

Then, in step S11, the S-CPU 46 increments by 1 an internal counter, which is prescribed in the internal memory 49 and corresponds to the input mode stored in the S-RAM 47 of the system controller 38. Namely, among eight internal counters prescribed in the internal memory 49, each corresponding to one of the eight image forming modes, the internal counter which corresponds to the input image forming mode is incremented by 1. The internal counter for each of the eight image forming modes is specified as shown in Table 2 below. If the input mode is the full color mode, only the second internal counter is incremented by 1, and the first internal counter is incremented by one if the mode is the black mode.

TABLE 2

| image forming mode | corresponding internal counter |
|---|---|
| full color mode | second counter |
| black mode | first counter |
| cyan mode | third counter |
| magenta mode | fourth counter |
| yellow mode | fifth counter |
| red mode | sixth counter |
| green mode | seventh counter |
| blue mode | eighth counter |

The above-mentioned operation of incrementing the internal counter is repeated the same number of times as the number of copies which is input by the operator as shown in step S12. Therefore, if the full color mode is input and the number of copies is set to N, the second internal counter is incremented by 4×N. If the black mode is input and the number of copies is set to N, the first internal counter is incremented by 1×N. Similarly, if the red mode is selected and the number of copies is set to N, the sixth internal counter is incremented by 2×N. Thus, the system controller 38 stores the accumulated number of times image formation has been executed for each of the plurality of image forming modes in the corresponding internal counters prescribed in the internal memory 49, which is a non-volatile memory.

Figure 5:
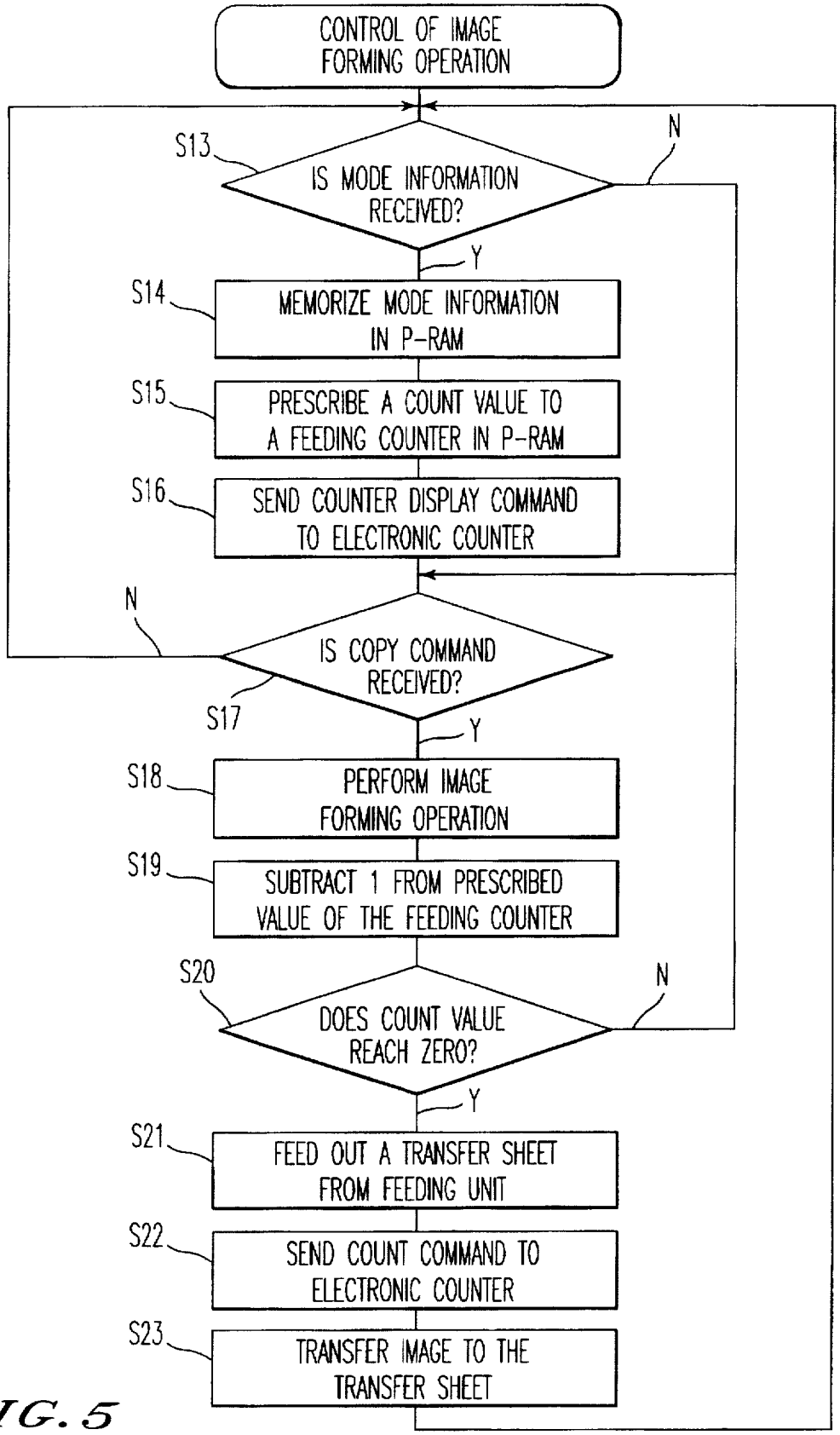
FIG. 5 is an operational flowchart of a printer controller of the apparatus for controlling the image forming operation and counting the number of times image formation has been executed for each image forming mode.

Next, FIG. 5 is a flowchart showing an operation of the printer controller 39 for controlling the image forming operation, including an operation of the P-CPU 50. As described earlier, the information of the input image forming mode is transmitted to the printer controller 39 as described in step S5 of FIG. 4. If the printer controller 39 receives the mode information in step S13, the printer controller 39 stores the mode information in the P-RAM 52 of the printer controller 39 in step S14.

After storing the mode information, the P-CPU 50 prescribes in step S15 a count value to a feeding counter in the P-RAM 52 in accordance with the image forming mode stored in the P-RAM 52 of the printer controller 39. The count value to be prescribed to the feeding counter for each image forming mode is the same as the one shown in Table 1, and among those prescribed count values, the count value corresponding to the input image forming mode is prescribed to the feeding counter in the P-RAM 52. Then, the P-CPU 50 sends in step S16 a counter display command, which corresponds to the image forming mode stored in the P-RAM 52, to the electronic counter 40. The accumulated number of times image formation has been executed for the input mode is displayed on the counter display 56 of the electronic counter 40 with this counter display command, which will be described later in more detail.

As described earlier, the system controller 38 issues the copy command to the printer controller 39 in step S8 of FIG. 4, and if the P-CPU 50 of the printer controller 39 receives the copy command in step S17, the P-CPU 50 performs in step S18 the image forming operation in accordance with the input image forming mode. That is, a toner image is formed on the photoconductor 5 shown in FIG. 1, and is then transferred to the intermediate transfer belt 14.

After the image forming operation is performed in step S18, the P-CPU 50 subtracts 1 from the prescribed count value of the feeding counter in the P-RAM 52 in step S19. For example, if the full color mode is input, the prescribed count value for the full color mode is 4 as shown in the Table 1, and the count value becomes 3 by subtracting 1 from the prescribed count value of 4. The P-CPU 50 receives the same number of copy commands as the prescribed count value for each mode, and the image forming operation is performed each time the copy command is received by the P-CPU 50. The operation of subtracting 1 from the prescribed count value is also performed each time the copy command is received by the P-CPU 50. If the count value reaches 0 in step S20, in step S21 the P-CPU 50 feeds out the transfer sheet 17 from the feeding unit 16 as described earlier.

If the image forming operation is repeated the number of times corresponding to the input image forming mode as described above, and an operation of feeding the transfer sheet 17 from the feeding unit 16 starts, in step S22 the P-CPU 50 sends out a count command corresponding to the image forming mode stored in the P-RAM 52 to the electronic counter 40, which will be explained in more detail later. The image on the intermediate transfer belt 14 is then transferred to the transfer sheet 17 in step S23.

When the number of copies input through the ten key pad 44 is plural, the operations from the step S17 of receiving the copy command to the step S23 of transferring the image to the transfer sheet 17 are performed for forming images on the second and the following transfer sheets respectively. The image forming mode information is not transmitted to the printer controller 39 from the system controller 38 for the operation for forming images on the second and the following transfer sheets.

While the image forming apparatus forms an image on a sheet in accordance with the input image forming mode as described above, the number of times such image formation has been executed is accumulated in a corresponding counter prescribed in a counter memory 53 of the electronic counter 40.

The counter memory 53 of the electronic counter 40, which is a non-volatile memory, includes the same number of counters as the total number of image forming modes, a first counter through an eighth counter, each corresponding to one of the eight image forming modes in this example as shown in Table 2.

Figure 6:
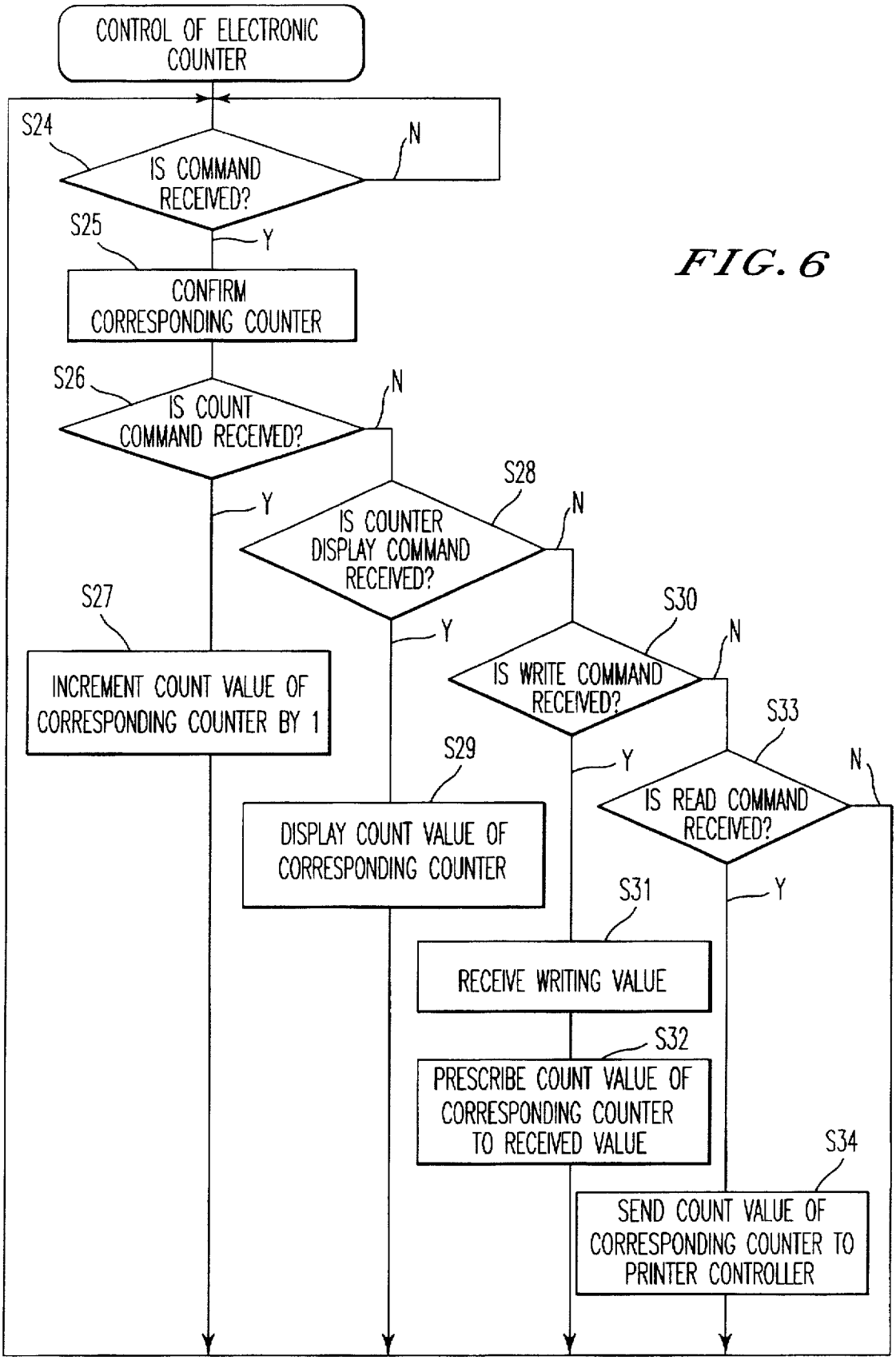
FIG. 6 is an operational flowchart of an electronic counter of the apparatus for accumulating the number of times image formation has been executed for each image forming mode and displaying the accumulated number on a counter display of the electronic counter.

FIG. 6 is a flowchart showing an operation of the C-CPU 55 of the electronic counter 40 for accumulating the number of times image formation has been executed for each of the plurality of image forming modes and for storing the accumulated number of times image formation has been executed for each of the plurality of image forming modes in a corresponding counter in the counter memory 53.

If the C-CPU 55 receives a command from the printer controller 39 in step S24, in step S25 the C-CPU 55 confirms a counter corresponding to the received command.

As described earlier in step S22 of FIG. 5, the printer controller 39 sends the count command corresponding to the image forming mode information stored in the P-RAM 52 to the electronic counter 40 for incrementing the corresponding counter. If the C-CPU 55 of the electronic counter 40 receives the count command in step S26, in step S27 the C-CPU 55 increments a count value of the corresponding counter by 1. For example, when the input image forming mode is the full color mode, a count value of the second counter is incremented by 1, and if the mode is the black mode, a count value of the first counter is incremented by 1. The above operation of incrementing a count value of the corresponding counter by 1 is repeated the same number of times as the number of copies to be made which is input by the operator through the ten key pad 44. The counter memory 53, which is a non-volatile memory, thus stores the accumulated number of times image formation has been executed for each image forming mode.

As described above, the image forming apparatus in this embodiment includes the electronic counter 40 having the non-volatile counter memory 53 which stores the accumulated number of times image formation has been executed for each of the plurality of image forming modes only by this electronic counter 40. The size of the electronic counter 40 is relatively small compared with the background mechanical counter having one counter for each of the plurality of image forming modes, and accordingly, the size of the image forming apparatus according to the present invention becomes relatively smaller than the apparatus having the above-mentioned background mechanical counter. Furthermore, the operator can easily read and confirm a count value indicated by the electronic counter 40 because there is only one counter which needs to be read by the operator, while the operator needs to read one of the plurality of indicated values placed side by side in the case of the background mechanical counter having one counter for each mode.

Further, as described earlier in step S17 of FIG. 5, the printer controller 39 sends the counter display command corresponding to the image forming mode which is input through the image forming mode inputting device to the electronic counter 40. When the C-CPU 55 of the electronic counter 50 receives the counter display command in the steps S24, S25 and S28, the C-CPU 55 displays in step S29 the count value stored in the corresponding counter in the counter memory 53 on the counter display 56.

Figure 7:
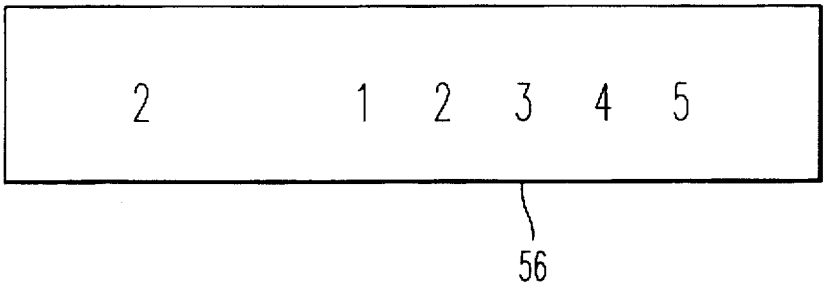
FIG. 7 is a diagram showing an example of an indication of the counter display of the apparatus.

FIG. 7 is a diagram showing an example of an indication of the counter display 56. In FIG. 7, the counter display 56 displays, as an example, a numeral specifying the counter corresponding to the input image forming mode and a numeral indicating the accumulated number of times image formation has been executed for the input mode, which is stored in the corresponding counter in the counter memory 53. In the case of the example shown in FIG. 7, the operator understands from the indication of the counter display 56 that the image forming mode is the full color mode because the numeral specifying the image forming mode is 2, and further that the accumulated number of times image formation has been executed for the full color mode is 12345.

Thus, the operator can identify the image forming mode which is selected and input by the operator from the numeral specifying each of the eight counters and can further understand the accumulated number of times image formation has been executed for the input image forming mode from the numeral following the numeral specifying the image forming mode. As described earlier, the counter display 56 becomes visible when the front cover of the main body of the printer part 2 is opened.

A write command shown in step S30 of FIG. 6 is a command for prescribing, at a manufacturing plant of the apparatus, an initial count value to each counter which is prescribed in the counter memory 53. The initial count value is usually prescribed to 0 and an input of the initial count value is made through manipulation of the ten key pad 44. After receiving the write command in the steps S30 and S31, the electronic counter 40 prescribes in step S32 the count value of the corresponding counter to the received value.

As described above, the image forming apparatus of this invention includes an operational panel which includes a device for inputting or selecting an image forming mode to form an image on a sheet, a first controller which counts the number of times image formation has been executed for each of the plurality of image forming modes, and a counter which accumulates the number of times image formation has been executed individually for each of the plurality of image forming modes, in accordance with a count signal for the corresponding image forming mode from the first controller, and stores the accumulated number of times image formation has been executed for each of the plurality of image forming modes in a memory provided in the counter. The counter further includes a display to display contents of the memory. The counter displays the accumulated number of times image formation has been executed for the image forming mode, in accordance with a display signal for the corresponding image forming mode from the first controller.

With the above-mentioned construction, the image forming apparatus of the present invention displays, each time the image forming mode is selected and input, the accumulated number of times image formation has been executed for the input image forming mode on the counter display 56 of the electronic counter 40. Therefore, each time the apparatus forms an image on a sheet in accordance with a selected image forming mode, the operator can see and confirm the accumulated number of times image formation has been executed for the input mode by checking an indication of the counter display 56 of the electronic counter 40.

While the image forming apparatus of this invention displays the accumulated number of times image formation has been executed for each image forming mode on the counter display 56 of the electronic counter 40 each time the apparatus forms an image on a sheet as described above, the apparatus further displays such an accumulated number of times image formation has been executed for each mode, which is stored with the counter memory 53 of the electronic counter 40, on the counter display 56 by manipulating the counter key 43 of the operational panel 41 shown in FIG. 2. Furthermore, the apparatus displays a count value of each counter in the internal memory 49 by manipulating the same counter key 43. Hereinbelow, details of the above-mentioned operations are explained.

Figure 8:
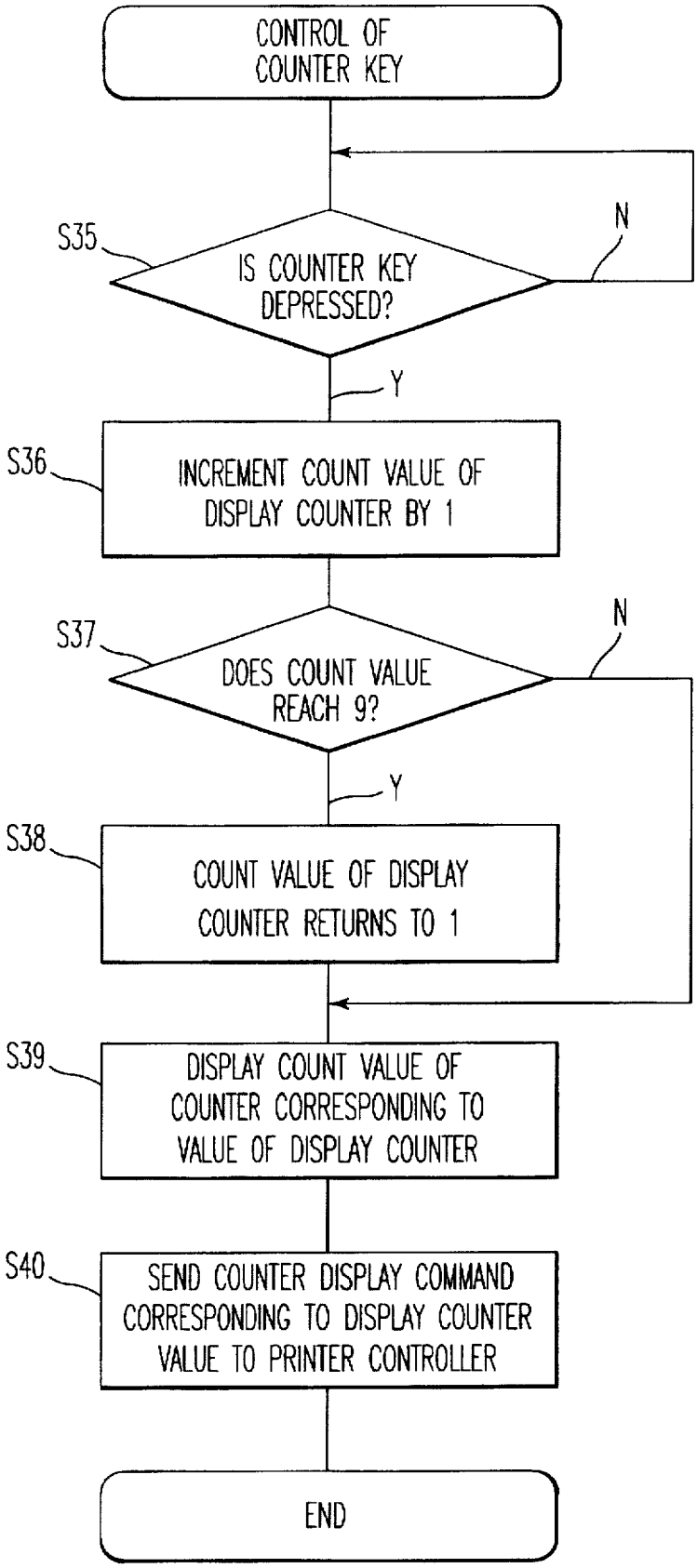
FIG. 8 is an operational flowchart of the system controller at the time a counter key of the operational panel is operated.

FIG. 8 is a flowchart showing an operation of the S-CPU 46 of the system controller 38, which is controlled by manipulation of the counter key 43.

First, if the S-CPU 46 determines that the counter key 43 is depressed in step S35, in step S36 the S-CPU 46 increments a count value of a display counter which is prescribed in the S-RAM 47 of the system controller 38 for displaying a number of times of depressing the counter key 43 on the operational display 42 of the operational panel 41 and on the counter display 56 of the electronic counter 40. The display counter is incremented by 1 each time the counter key 43 is depressed, and if in step S37 the number of times of the increment exceeds the number of the image forming modes, 8 in this example, in step S38 the display counter returns to 1. Namely, when the number of times of depressing the counter key 43 reaches 9, the value of the display counter returns to 1, and then, the display counter starts to be incremented by 1 again each time the counter key 43 is depressed.

Thus, the operator (including a service personnel) selects an image forming mode whose accumulated number of times image formation has been executed the operator desires to display, based upon the number of times of depressing the counter key 43.

The value of the display counter at which the operator discontinues depressing the counter key 43 further specifies a counter in the internal memory 49 and a counter in the counter memory of the electronic counter 40. For example, if the operator depresses the counter key 43 once and discontinues depressing the counter key 43, the value of the display counter is 1 and the corresponding counter is the first counter, which stores the accumulated number of times image formation has been executed for the black mode, of the eight counters, as shown in the Table 2, which are prescribed in the internal memory 49 and the counter memory 53 respectively. If the operator depresses the counter key 43 two times and then discontinues depressing the counter key 43, the value of the display counter is 2 and the corresponding counter is the second counter in the Table 2. Thus, the operator can select a counter in the internal memory 49 and the counter memory 53 from among a plurality of counters prescribed therein respectively based upon the number of times of depressing the counter key 43.

The S-CPU 46 then displays in step S39, on the operational display 42 of the operational panel 41, the accumulated number of times image formation has been executed, which is stored in the counter in the internal memory 49 specified by the value of the display counter selected, based upon the number of times of depression of the counter key 43 by the operator as described above. For example, if the value of the display counter is 1, the accumulated number of times image formation has been executed for the black mode, which is stored in the first counter, is displayed on the operational display 42, and if the value of the display counter is 2, the accumulated number of times image formation has been executed for the full color mode, which is stored in the second counter, is displayed on the operational display 42.

The operational display 42 displays in the same manner as the counter display 56, as shown in FIG. 7, a numeral specifying the counter corresponding to the selected image forming mode and a numeral indicating the accumulated number of times image formation has been executed for the selected mode, which is stored in the corresponding counter. Thus, the operator can see and recognize the accumulated number of times image formation has been executed for each of the plurality of image forming modes without opening the front door of the image forming apparatus on the operational display 42 provided outside of the apparatus.

Further, in step S40 the S-CPU 46 sends a counter display command corresponding to the selected value of the display counter to the printer controller 39 for displaying the accumulated number of times image formation has been executed for the image forming mode corresponding to the value of the display counter which is selected by the operator based upon the number of times of depressing the counter key 43.

Figure 9:
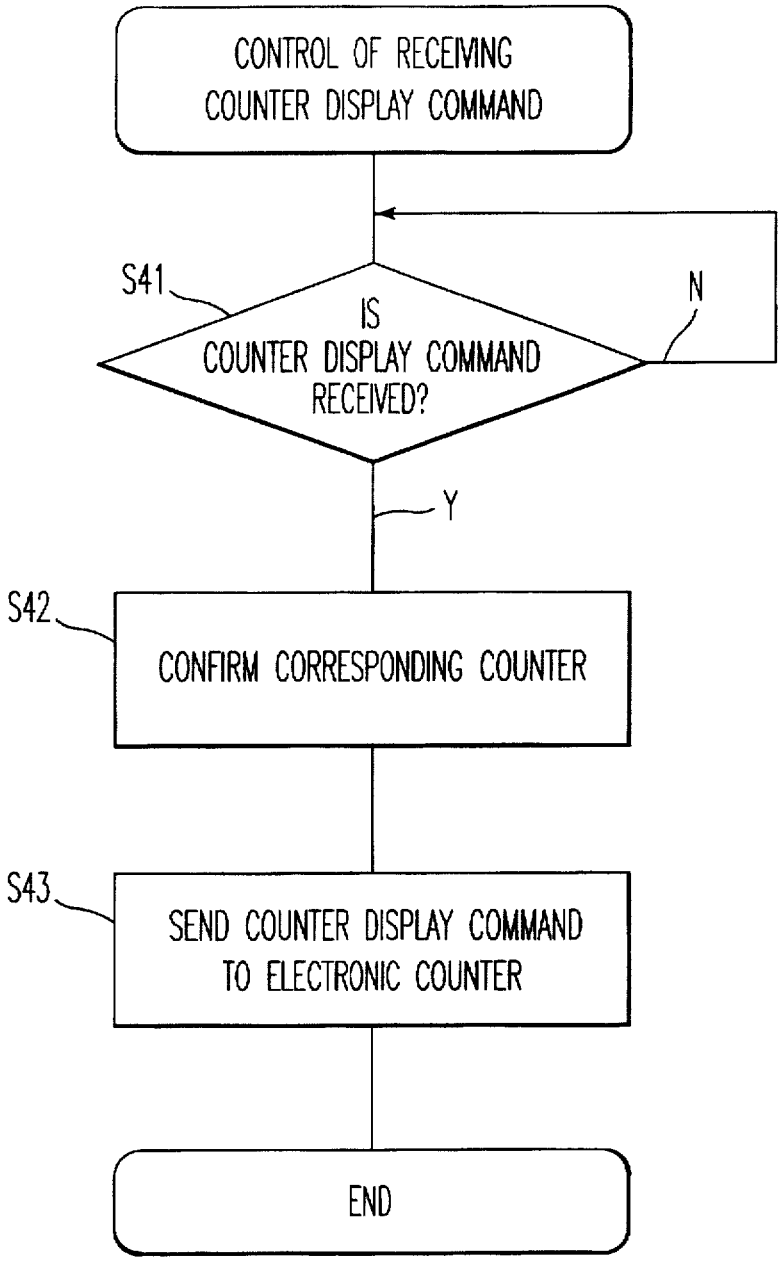
FIG. 9 is an operational flowchart of the printer controller at the time the counter key of the operational panel is operated.

FIG. 9 is a flowchart showing an operation of the P-CPU 50 at the time when the printer controller 39 receives the above-mentioned counter display command. If the P-CPU 50 receives the counter display command from the system controller 38 in step S41, the P-CPU 50 confirms in step S42 the corresponding counter in the counter memory 53, and then sends in step S43 the counter display command corresponding to the confirmed counter to the electronic counter 40.

If the C-CPU 55 of the electronic counter 40 receives the counter display command, the C-CPU 55 displays on the counter display 56 the count value of the designated counter in the counter memory 53 as shown in steps S28 and S29 of FIG. 6. Thus, the operator can display the accumulated number of times image formation has been executed for the image forming mode which is selected by the operator, on the counter display 56 of the electronic counter 40.

As described above, the image forming apparatus of the present invention further includes a device for switching from among the plurality of image forming modes the selected image forming mode the operator desires to input to the counter for displaying on the display of the counter the accumulated number of times image formation has been executed for such an input mode which is stored in the first memory of the counter. The first controller transmits the information of the image forming mode which is selected and input by the operator through the mode switching device to the counter. In this embodiment, the counter key 43 provided in the operational panel 41 constitutes the above-mentioned mode switching device.

With the above-mentioned construction, an operator of the apparatus, including a service personnel of a servicing firm, can display on the counter display 56 of the electronic counter 40 the accumulated number of times image formation has been executed for each of the plurality of image forming modes, which is stored in a corresponding counter in the counter memory 53 of the electronic counter 40, at any time the operator desires to recognize and confirm such an accumulated number of times image formation has been executed for each mode, by simply selecting a desired image forming mode by manipulating the counter key 43 of the operational panel 41.

Further, the operator can display the accumulated number of times image formation has been executed for each of the plurality of image forming modes, which is stored in the corresponding counter in the internal memory 49, on the operational display 42 of the operational panel 41 by switching a desired image forming mode through manipulation of the counter key 43 as described above. Therefore, with the above-mentioned construction, the operator can recognize the accumulated number of times image formation has been executed for the desired mode by simply seeing an indication displayed on the operational display 42 of the operational panel 41, which is provided outside of the apparatus, while the front cover of the apparatus needs to be opened for seeing an indication of the electronic counter 40 provided inside of the apparatus. The operator can therefore easily verify a billing amount from the servicing firm, with no need to open the front cover of the apparatus, by simply displaying on the operational display 42 the accumulated number of times image formation has been executed for each mode which is stored in the internal memory 49 and checking such number with the number included in the bill.

As described above, the image forming apparatus according to the present invention stores the accumulated number of times image formation has been executed for each image forming mode in the internal memory 49 of the system controller 38 and also in the counter memory 53 of the electronic counter 40. A maintenance fee of the apparatus is generally determined based upon the number of times image formation has been executed in a certain period of time as explained earlier, and therefore it is a very important feature of the apparatus to count and accumulate such number of times image formation has been executed in a reliable manner. However, it is inevitable that an electronic device sometimes malfunctions, and therefore the image forming apparatus of the present invention is so constructed to count the number of times image formation has been executed for each of the plurality of image forming modes with two controllers, and to store the accumulated number of times image formation has been executed for each of the plurality of image forming modes with the two memories as described above for increasing validity of such accumulated numbers stored in the apparatus.

However, with the above-mentioned construction, if the power switch of the apparatus is turned off immediately after the system controller 38 issues a copy command to the printer controller 39 (step 8 of FIG. 4), it may occur that a counter prescribed in the counter memory 53 of the electronic counter 40 is incremented while a corresponding counter prescribed in the internal memory 49 of the system controller 38 is not incremented, or vice versa. If such a case occurs, the count value of the counter in the internal memory 49 differs from the count value of the corresponding counter in the counter memory 53 and such a difference in the count values may cause a disagreement between the servicing firm and the user about the validity of the record of the number of times of image formation has been executed based on which a maintenance fee of the apparatus is determined.

Therefore, the image forming apparatus according to the present invention is so constructed to calculate a difference between a count value of a counter prescribed in the internal memory 49 and a count value of a corresponding counter in the counter memory 53 of the electronic counter 40 and to display, if the difference between the two count values exceeds a predetermined value, a message indicating an occurrence of such a difference on the operational display 42.

Figure 10:
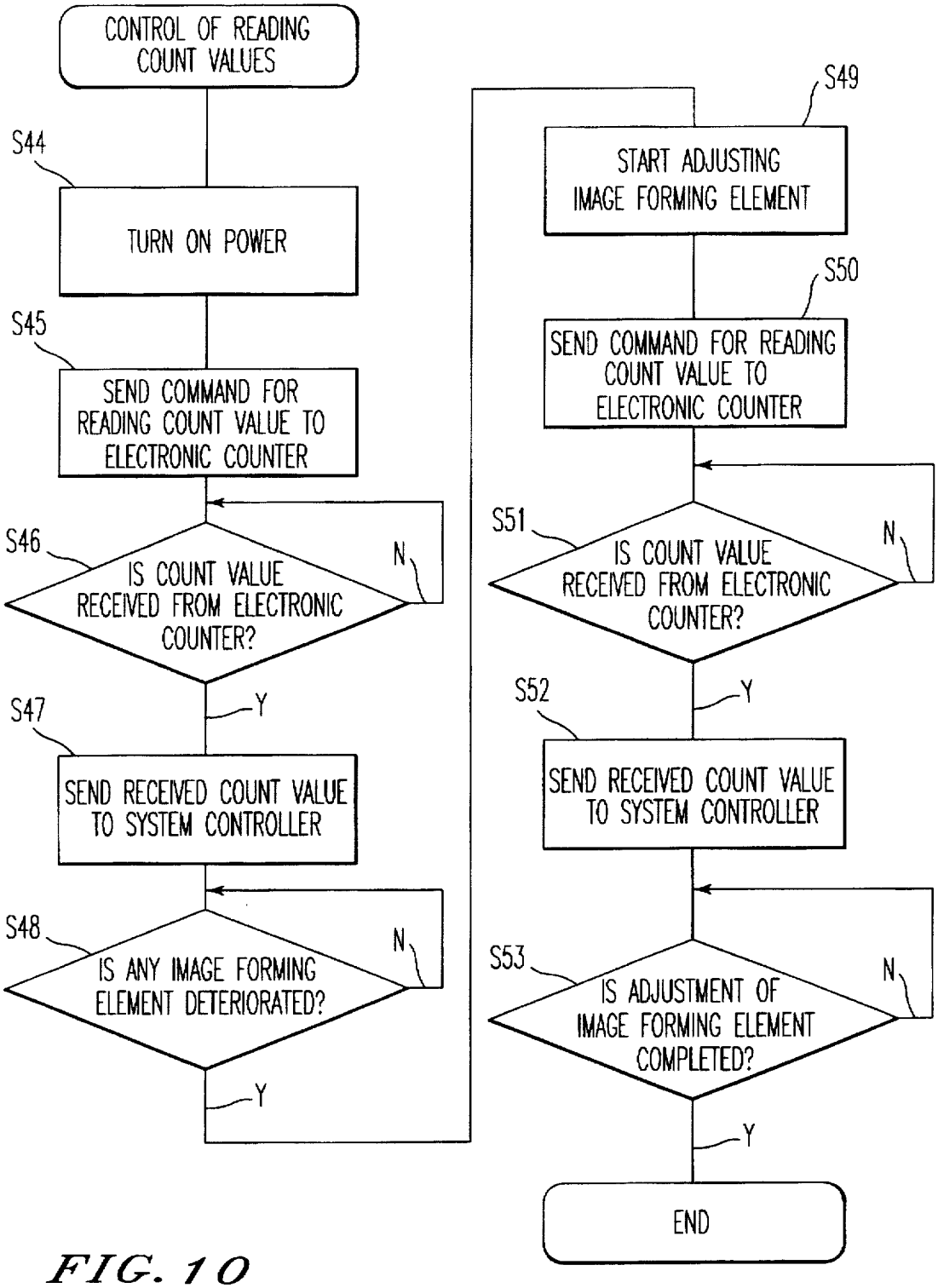
FIG. 10 is an operational flowchart of the printer controller for reading a count value of a counter of the electronic counter and sending the read value to the system controller to calculate a difference between the count value of the counter of the electronic counter and a count value of a corresponding counter of the system controller.

FIG. 10 is a flowchart showing an operation of the P-CPU 50 of the printer controller 39 for reading a count value of a counter prescribed in the counter memory 53 and for sending the read value to the system controller 38 to calculate a difference between the count value of the counter in the counter memory 53 and a count value of a corresponding counter in the internal memory 49.

In FIG. 10, when the power of the image forming apparatus is turned on in step S44, the P-CPU 50 sends in step S45 a command to read a count value of a counter in the counter memory 53 to the electronic counter 40.

The electronic counter 40 checks if a read command is received in step S33 of FIG. 6, and if the read command is received in step S33, in step S34 of FIG. 6 the electronic counter 40 reads a count value of a corresponding counter in the counter memory 53 and sends the read value back to the printer controller 39.

If the P-CPU 50 receives the count value sent from the electronic counter 40 in step S46 of FIG. 10, the P-CPU 50 sends the received count value to the S-CPU 46 of the system controller 38 in step S47.

Figure 11:
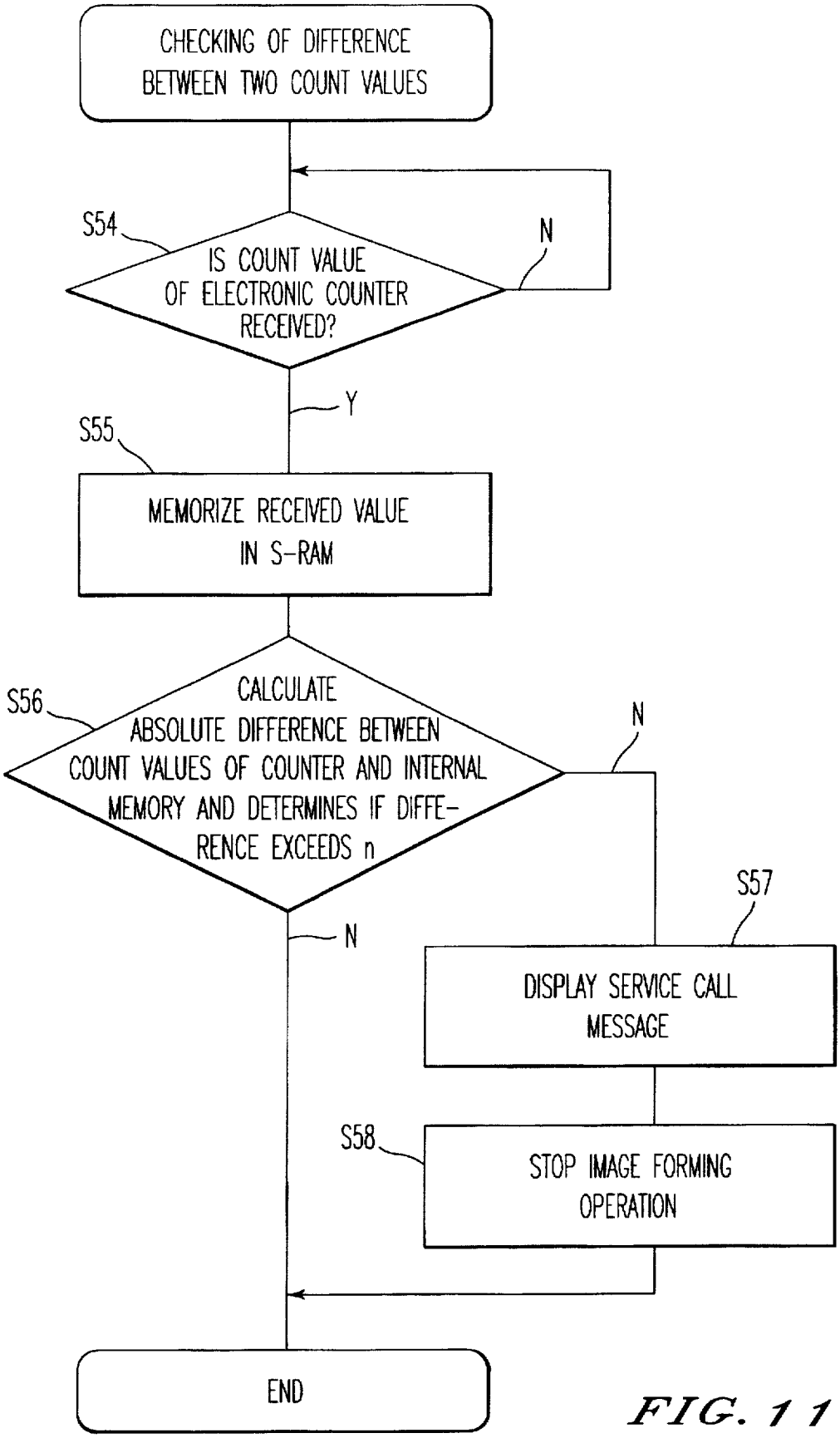
FIG. 11 is an operational flowchart of the system controller for calculating a difference between a count value of a counter of the electronic counter and a count value of a corresponding counter of the system controller and determining if the difference exceeds a predetermined value.

FIG. 11 is a flowchart showing an operation of the S-CPU 46 of the system controller 38 for calculating a difference between a count value of a counter of the electronic counter 40 and a count value of a corresponding counter of the internal memory 49 and for determining if the difference exceeds a predetermined value. If the S-CPU 46 receives a count value of a counter of the electronic counter 40 in step S54, the S-CPU 46 stores the count value received from the printer controller 38 in the S-RAM 47 in step S55. Then, in step S56, the S-CPU 46 calculates an absolute difference value between the count value of the electronic counter 40, which is stored in the S-RAM 47, and a corresponding count value of the internal memory 49. If the absolute difference value exceeds a predetermined value n, a message indicating such a fact is displayed on the operational display 42 in step S57. Generally, such a message is displayed on the operational display 42 as a service call message indicating that the apparatus needs to be serviced by a servicing firm. Then, the S-CPU 46 executes an operation of stopping the image forming operation in step S58. As the above-mentioned value n, an appropriate value including 0 is prescribed. Generally, a value around 3 is prescribed.

As described above, the image forming apparatus of the present invention compares a count value of a counter prescribed in the counter memory 53 of the electronic counter 40 with a count value of a corresponding counter prescribed in the internal memory 49 of the system controller 38 and displays, if a difference between the two count values exceeds a predetermined value, a message indicating such a fact on the operational display 42 to inform an operator of an occurrence of abnormal conditions in the apparatus. Generally, when such a message is displayed, a user of the apparatus requests the servicing firm to check conditions of the apparatus.

Therefore, the apparatus can prevent a situation that a difference between a count value of each counter in the counter memory 53, based on which the servicing firm generally determines a billing amount to the user for maintenance of the apparatus, and a count value of a corresponding counter in the internal memory 46, based on which the user generally verifies such billing amount from the servicing firm, becomes unexpectedly large, which may cause a disagreement between the servicing firm and the user with respect to the actual accumulated number of times image formation has been executed.

As described above, the image forming apparatus of this invention is provided with a device for calculating a difference between the accumulated number of times image formation has been executed for each of the plurality of image forming modes which is stored in the counter memory 53 of the electronic counter 40 and the accumulated number of times image formation has been executed for each mode which is stored in the internal memory 49 of the system controller 38 and for determining if the difference exceeds a predetermined value n. The apparatus is further provided with a device for displaying, when the difference exceeds the predetermined value n, a message indicating that the difference exceeds the predetermined value n on the operational display 42. In the embodiment shown in the drawings, the S-CPU 46 constitutes the above-mentioned calculating device and displaying device.

As described above, the image forming apparatus 1 checks if a difference between a count value of a counter in the counter memory 53 of the electronic counter 40 and a count value of a corresponding counter in the internal memory 49 of the system controller 38 exceeds a predetermined value n each time the power of the apparatus is turned on. Therefore, if the user turns off the apparatus at the end of a work day and turns on the apparatus at a start of a next work day, the apparatus performs the above-mentioned checking operation daily and occurrence of abnormal conditions of the apparatus is checked at the start of work daily. However, if the user does not turn off the apparatus daily as mentioned above, and continues to leave the power of the apparatus on for a long period of time, the above-mentioned checking operation is not performed for that period of time and there may occur a case that a difference between a count value of a counter in the electronic counter 40 and a count value of a corresponding counter in the internal memory 49 of the system controller 38 is relatively large when the apparatus, having been finally turned off and turned on, performs the above-mentioned checking operation.

Therefore, the image forming apparatus of the present invention is so constructed to perform the above-mentioned checking operation not only when the apparatus is turned on, but also when the apparatus performs an operation of adjusting a property of image forming elements of the apparatus to an appropriate level, which is performed when deterioration of the property is detected with any of the image forming elements.

Namely, the P-CPU 50 of the printer controller 39 checks in step S48 of FIG. 10 if a property of any of the image forming elements is deteriorated, and if deterioration of the property is detected in any of the elements, the P-CPU 50 performs in step S49 an operation of adjusting the property of the element to an appropriate level. For example, a surface potential electrometer (not shown), may be provided facing the photoconductor 5 in FIG. 1, and can check if a surface potential of the photoconductor 5 after having been charged is lower than a predetermined level, and if the surface potential is found to be lower than the predetermined level, an applied voltage to the charger 6 is adjusted to a higher level to accomplish the appropriate level of the surface potential of the photoconductor 5.

After such an operation of adjusting a property of an image forming element starts, the above-mentioned operation of reading a count value of a counter of the counter memory 53 and sending the read value to the system controller 38 for calculating a difference between the count value of the counter of the counter memory 53 with a count value of a corresponding counter of the internal memory 49 is performed. Namely, the P-CPU 50 sends out in step S50 of FIG. 10 a reading command for reading a count value of a counter in the counter memory 53 to the electronic counter 40, and in response to this command, the electronic counter 40 sends back a count value of a counter to the printer controller 39 in the steps S33 and S34 of FIG. 6. The printer controller 39 then sends the received count value of the electronic counter 40 to the system controller 38 in the steps S51 and S52, and the S-CPU 46 of the system controller 38 calculates a difference between the count value of the counter of the electronic counter 40 and a count value of a corresponding counter in the internal memory 49 of the system controller 38 in steps S54, S55 and S56 of FIG. 11. If the absolute value of the resulting difference exceeds a predetermined value n, the operational display 42 displays a message for a service call in step S57 and the image forming operation is stopped in step S58 of FIG. 11. After sending the count values to the system controller 38, the printer controller 39 completes the operation of adjusting the image forming element in step S53.

As described above, the image forming apparatus with the aforementioned construction detects if a difference of count values between the electronic counter 53 and the internal memory 49 of the system controller 38 exceeds a predetermined level each time the apparatus performs an adjustment of an image forming element. Therefore, the apparatus can avoid a situation that a difference between a count value of a counter in the electronic counter 40 and a count value of a corresponding counter in the internal memory 49 of the system controller 38 becomes unexpectedly large even when the user does not turn off the apparatus for a long time.

Further, since an operation of forming an image on a sheet is not performed when the above-mentioned adjustment of the property of an image forming element is performed, there does not occur a problem that the accumulated number of times image formation has been executed which is stored in the counter memory 53 of the electronic counter 40 or the accumulated number of times image formation has been executed which is stored in the internal memory 49 is incremented while the above-mentioned checking operation is being performed, while such a problem may occur if the above-mentioned checking operation is performed each time the operation of forming an image on a sheet is performed.

Although embodiments of the present invention are explained with a case of an image forming apparatus having 8 different image forming modes as an example, the present invention is obviously applicable to an image forming apparatus having any number of image forming modes other than 8.

Further, obviously numerous additional modifications and variations of the present invention are possible in light of the above teachings. It is therefore to be understood that within the scope of the appended claims, the present invention may be practiced otherwise than are specifically described herein.

What is claimed as new and desired to be secured by Letters Patent of the United States is:

1. An image forming apparatus which forms an image on a sheet in accordance with an image forming mode selected from among a plurality of image forming modes, comprising:

an operational panel including an image forming mode input device for selecting executing one of the plurality of image forming modes to form an image on a sheet;

a first controller which counts a number of times image formation has been executed for each of the plurality of image forming modes selected through said image forming mode input device; and a counter which accumulates individually the number of times image formation has been executed for each of the plurality of image forming modes selected through said image forming mode input device in accordance with a count signal for the corresponding image forming mode from said first controller, said counter having a first memory to store the accumulated number of times image formation has been executed for each of the plurality of image forming modes and a first display to display contents of said first memory;

wherein said first controller sends to said counter a display signal for displaying the accumulated number of times image formation has been executed for the image forming mode selected through said image forming mode input device and said counter displays on said first display the accumulated number of times image formation has been executed for the image forming mode selected through said image forming mode input device, which is stored in said first memory of said counter, in accordance with said display signal for the corresponding image forming mode selected through the image forming mode input device which is received from the first controller.

2. The image forming apparatus according to claim 1, further comprising a device for switching the selected image forming mode from among the plurality of image forming modes and for displaying on said first display the accumulated number of times image formation has been executed for the selected image forming mode, which is stored in said first memory of said counter.

3. The image forming apparatus according to claim 2, wherein said first memory is a non-volatile memory.

4. The image forming apparatus according to claim 2, further comprising:

a second controller which counts and accumulates the number of times image formation has been executed for each of the plurality of image forming modes selected through said image forming mode input device, said second controller including a second memory to store the accumulated number of times image formation has been executed for each of the plurality of image forming modes; and a second display provided on said operational panel for displaying contents of said second memory; and said second controller controlling to display on said second display the accumulated number of times image formation has been executed for the mode selected by said mode switching device, which is stored in said second memory of said second controller.

5. The image forming apparatus according to claim 4, wherein said second memory is a non-volatile memory.

6. The image forming apparatus according to claim 5, further comprising:

a device for calculating a difference between the accumulated number of times image formation has been executed for each of the plurality of image forming modes stored in the first memory of said counter and the corresponding accumulated number of times image formation has been executed stored in said second memory of said second controller and determining if the difference exceeds a predetermined value; and a device for displaying, when the difference exceeds the predetermined value, a message indicating that the difference exceeds the predetermined value on said second display.

7. The image forming apparatus according to claim 6, wherein said calculating device calculates the difference and determines if the difference exceeds the predetermined value each time the image forming apparatus is turned on and each time the image forming apparatus adjusts image forming elements of the apparatus for correcting deterioration of the image forming elements.

8. The image forming apparatus according to claim 4, further comprising:

a device for calculating a difference between the accumulated number of times image formation has been executed for each of the plurality of image forming modes stored in the first memory of said counter and the corresponding accumulated number of times image formation has been executed stored in said second memory of said second controller and determining if the difference exceeds a predetermined value; and a device for displaying, when the difference exceeds the predetermined value, a message indicating that the difference exceeds the predetermined value on said second display.

9. The image forming apparatus according to claim 8, wherein said calculating device calculates the difference and determines if the difference exceeds the predetermined value each time the image forming apparatus is turned on and each time the image forming apparatus adjusts image forming elements of the apparatus for correcting deterioration of the image forming elements.

10. The image forming apparatus according to claim 2, wherein said switching device switches the selected image forming mode and displays on said first display the accumulated number of times image formation has been executed for the selected image forming mode in accordance with the number of times said switching device is depressed.

11. The image forming apparatus according to claim 1, wherein said first memory is a non-volatile memory.

12. The image forming apparatus according to claim 1, further comprising:

a second controller which counts and accumulates the number of times image formation has been executed for each of the plurality of image forming modes selected through said image forming mode input device, said second controller including a second memory to store the accumulated number of times image formation has been executed for each of the plurality of image forming modes; and a second display provided on said operational panel for displaying contents of said second memory; and said second controller controlling to display on said second display the accumulated number of times image formation has been executed for the mode selected by said mode switching device, which is stored in said second memory of said second controller.

13. The image forming apparatus according to claim 12, wherein said second memory is a non-volatile memory.

14. The image forming apparatus according to claim 13, further comprising:

a device for calculating a difference between the accumulated number of times image formation has been executed for each of the plurality of image forming modes stored in the first memory of said counter and the corresponding accumulated number of times image formation has been executed stored in said second memory of said second controller and determining if the difference exceeds a predetermined value; and a device for displaying, when the difference exceeds the predetermined value, a message indicating that the difference exceeds the predetermined value on said second display.

15. The image forming apparatus according to claim 14, wherein said calculating device calculates the difference and determines if the difference exceeds the predetermined value each time the image forming apparatus is turned on and each time the image forming apparatus adjusts image forming elements of the apparatus for correcting deterioration of the image forming elements.

16. The image forming apparatus according to claim 12, further comprising:

a device for calculating a difference between the accumulated number of times image formation has been executed for each of the plurality of image forming modes stored in the first memory of said counter and the corresponding accumulated number of times image formation has been executed stored in said second memory of said second controller and determining if the difference exceeds a predetermined value; and a device for displaying, when the difference exceeds the predetermined value, a message indicating that the difference exceeds the predetermined value on said second display.

17. The image forming apparatus according to claim 16, wherein said calculating device calculates the difference and determines if the difference exceeds the predetermined value each time the image forming apparatus is turned on and each time the image forming apparatus adjusts image forming elements of the apparatus for correcting deterioration of the image forming elements.

18. The image forming apparatus according to claim 1, wherein a count value corresponding to the number of times an image forming operation is performed for forming an image is prescribed for each mode in said counter, the count value prescribed for the mode selected through said image forming mode input device is subtracted by one each time the image forming operation is performed and the corresponding accumulated number of times image formation has been executed is incremented by one when the count value reaches zero.

19. The image forming apparatus according to claim 1, further comprising a cover, and wherein said first display is disposed so as to be exposed to an operator when the cover is opened.

20. An image forming apparatus which forms an image on a sheet in accordance with an image forming mode selected from among a plurality of image forming modes, comprising:

an operational panel including an image forming mode input device for selecting executing one of the plurality of image forming modes to form an image on a sheet;

a first controller which counts a number of times image formation has been executed for each of the plurality of image forming modes selected through said image forming mode input device; and a counter which accumulates individually the number of times image formation has been executed for each of the plurality of image forming modes selected through said image forming mode input device in accordance with a count signal for the corresponding image forming mode from said first controller, said counter having a first memory to store the accumulated number of times image formation has been executed for each of the plurality of image forming modes and a first display to display contents of said first memory;

a second controller which counts and accumulates the number of times image formation has been executed for each of the plurality of image forming modes selected through said image forming mode input device, said second controller including a second memory to store the accumulated number of times image formation has been executed for each of the plurality of image forming modes;

a second display provided on said operational panel for displaying contents of said second memory; and said second controller controlling to display on said second display the accumulated number of times image formation has been executed for the mode selected by said mode switching device, which is stored in said second memory of said second controller.

21. The image forming apparatus according to claim 20, wherein said second memory is a non-volatile memory.

22. The image forming apparatus according to claim 21, wherein said second memory is a non-volatile memory.

23. The image forming apparatus according to claim 22, further comprising:

a device for calculating a difference between the accumulated number of times image formation has been executed for each of the plurality of image forming modes stored in the first memory of said counter and the corresponding accumulated number of times image formation has been executed stored in said second memory of said second controller and determining if the difference exceeds a predetermined value; and a device for displaying, when the difference exceeds the predetermined value, a message indicating that the difference exceeds the predetermined value on said second display.

24. The image forming apparatus according to claim 23, wherein said calculating device calculates the difference and determines if the difference exceeds the predetermined value each time the image forming apparatus is turned on and each time the image forming apparatus adjusts image forming elements of the apparatus for correcting deterioration of the image forming elements.

25. The image forming apparatus according to claim 21, further comprising:

a device for calculating a difference between the accumulated number of times image formation has been executed for each of the plurality of image forming modes stored in the first memory of said counter and the corresponding accumulated number of times image formation has been executed stored in said second memory of said second controller and determining if the difference exceeds a predetermined value; and a device for displaying, when the difference exceeds the predetermined value, a message indicating that the difference exceeds the predetermined value on said second display.

26. The image forming apparatus according to claim 25, wherein said calculating device calculates the difference and determines if the difference exceeds the predetermined value each time the image forming apparatus is turned on and each time the image forming apparatus adjusts image forming elements of the apparatus for correcting deterioration of the image forming elements.

27. The image forming apparatus according to claim 20, further comprising:

a device for calculating a difference between the accumulated number of times image formation has been executed for each of the plurality of image forming modes stored in the first memory of said counter and the corresponding accumulated number of times image formation has been executed stored in said second memory of said second controller and determining if the difference exceeds a predetermined value; and a device for displaying, when the difference exceeds the predetermined value, a message indicating that the difference exceeds the predetermined value on said second display.

28. The image forming apparatus according to claim 27, wherein said calculating device calculates the difference and determines if the difference exceeds the predetermined value each time the image forming apparatus is turned on and each time the image forming apparatus adjusts image forming elements of the apparatus for correcting deterioration of the image forming elements.

29. The image forming apparatus according to claim 20, further comprising a cover, and wherein said first display is disposed so as to be exposed to an operator when the cover is opened.

30. An image forming apparatus which forms an image on a sheet in accordance with an image forming mode selected from among a plurality of image forming modes, comprising:

an image forming mode input device for selecting an image forming mode to form an image on a sheet; and a counter which counts and accumulates individually a number of times image formation has been executed for each of the plurality of image forming modes selected through said image forming mode input device, which stores the accumulated number of times image formation has been executed for each of the plurality of image forming modes individually in a memory provided in said counter and which receives a display signal for displaying the accumulated number of times image formation has been executed for the image forming mode selected through said image forming mode input device and said counter displays on a display provided in said counter the accumulated number of times image formation has been executed for the mode input device, which is stored in said memory of said counter, in accordance with said display signal for the corresponding image forming mode selected through the image forming mode input device.

* * * * *